US006647743B2

(12) United States Patent
Moore

(10) Patent No.: US 6,647,743 B2
(45) Date of Patent: Nov. 18, 2003

(54) METHOD AND APPARATUS FOR INDIVIDUAL DISPOSABLE PACKAGES FOR FREEZABLE SUBSTANCES AND A CONTAINER THEREOF

(76) Inventor: Pamela R. Moore, P.O. Box 334, Tallmadge, OH (US) 44278

( * ) Notice: Subject to any disclaimer, the term of this patent is extended or adjusted under 35 U.S.C. 154(b) by 0 days.

(21) Appl. No.: 09/943,191

(22) Filed: Aug. 30, 2001

(65) Prior Publication Data

US 2002/0050150 A1 May 2, 2002

Related U.S. Application Data

(60) Provisional application No. 60/294,104, filed on May 29, 2001, and provisional application No. 60/228,986, filed on Aug. 30, 2000.

(51) Int. Cl.[7] ..... F25D 3/08; B28B 7/24

(52) U.S. Cl. ..... 62/530; 62/457.2; 62/371; 249/121

(58) Field of Search ..... 62/530, 457.2, 62/371–457.1, 60; 165/46; 426/410; 249/121, 126

(56) References Cited

U.S. PATENT DOCUMENTS 2,036,706 A * 4/1936 Law
2,713,543 A * 7/1955 Peters
3,565,389 A * 2/1971 Price ..... 249/121
4,091,632 A * 5/1978 Marchewka et al. ..... 62/530
5,971,352 A * 10/1999 Kirks ..... 249/117
6,182,452 B1 * 2/2001 Wright et al. ..... 62/1

* cited by examiner

*Primary Examiner*—Chen Wen Jiang
(74) *Attorney, Agent, or Firm*—Brouse McDowell; Roger D. Emerson; Heather M. Barnes

(57) ABSTRACT

An article for holding freezable substances includes an individual disposable package for holding the frozen substance and a container therefore. The package is comprised of a bottom portion and a top portion. The frozen substance is placed in the bottom portion and the top portion is placed over the bottom portion to seal the package and prevent spillage of the freezable substance prior to its freezing. The package has a maximum inner width Wm, with Wm being less than or equal to 0.875 inches (22.23 mm). The width Wm is chosen so that a long, cylindrical ice cube is formed by the package. The ice cube so formed fits easily into original containers of beverages, such as soda cans and bottles, so that the beverages are cooled in their original containers.

9 Claims, 4 Drawing Sheets

METHOD AND APPARATUS FOR INDIVIDUAL DISPOSABLE PACKAGES FOR FREEZABLE SUBSTANCES AND A CONTAINER THEREOF

This application claims the benefit of U.S. Provisional Application, Ser. No. 60/228,986, entitled Method and Apparatus For Individual Disposable Packages For Freezable Substances and A Container Thereof filed on Aug. 30, 2000, in Express Mail Label No. EL696638368US and U.S. Provisional Application, Ser. No. 60/294,104, entitled Method and Apparatus For Individual Disposable Packages For Freezable Substances and A Container Thereof II, filed on May 29, 2001, in Express Mail Label No. EL722376870US by the same inventor, Pamela R. Moore.

BACKGROUND OF THE INVENTION

This invention pertains to methods and apparatuses for chilling beverages, and more specifically to methods and apparatuses for making an individual disposable package for freezable substances that is contained within a container, wherein the freezable substances, once frozen, have an elongated, narrow form such that they can be removed from the disposable package and inserted into a beverage container, beverage can, juice can, water bottle, sports bottle or the like and can more effectively cool the entire depth of the beverage.

DESCRIPTION OF THE RELATED ART

Basic "cube-shaped" ice "cubes" and ice cube trays are known in the prior art. Typically, ice cube trays are designed to produce ice cubes having a cubic or rectangular form. The prior art also teaches ice cube trays which produce ice cubes having a variety of forms. For example, in U.S. Pat. No. 4,417,716 an ice tray is disclosed which forms completely enclosed chambers of different shaped ice. Further, in U.S. Pat. No. Des. 287,856 another shaped ice cube tray is disclosed. Other designs are disclosed in U.S. Pat. Nos. Des. D244,275; D292,802; and D318,281.

In addition, the manufacture and sale of pre-packaged containers of ice to consumers is also well known in the art. Bags of pre-packaged ice can be purchased at almost any gas station, convenience store or grocery store in the country. Similarly, most stores also sell pre-packaged containers of reusable "ice-cubes". These reusable "ice cubes" consist of a plastic mold filled with a freezable substance (usually water). The plastic mold including the freezable substance is frozen and the mold is placed in a beverage container to cool the beverage. Once the freezable substance melts, the mold can be refrozen and reused.

Notwithstanding the fact that the prior art teaches both ice cubes having a variety of forms and the pre-packaging of ice cubes, the prior art does not teach individual disposable packages for frozen substances, containers for these disposable packages, or a method of freezing a substance such that the freezable substance, once frozen, has an elongated form such that the frozen substance is insertable into a beverage container, beverage can, juice can, water bottle, sports bottle or the like and resultingly more effectively cools the entire depth of the beverage.

For example, a conventional beverage can has a depth of about 5.0 inches (127 mm) and has an opening with a width of about 0.75 inches (19.05 mm). Beverage containers such as water, soda or beverage bottles have various depths ranging from about 11.0 inches (279.4 mm) for a typical polyester two liter bottle to about 6.0 inches (152.4 mm) for a typical bottled water bottle. These containers also have openings of various widths. Neither the conventional cubic or rectangular ice cubes, nor the various forms of ice cubes that the prior art teaches, are insertable within these containers because of the narrowness of the containers' openings. Consequently these beverages can not be easily cooled in their containers by the addition of ice cubes or other frozen substances. The only way to cool these beverages while they are in their containers is to place them into a cool environment such as a refrigerator, freezer, ice box, ice bucket, cooler, tub of ice, or the like. However, the introduction of a beverage container into a very cold environment can lead to a messy result as the beverage container may rupture as the freezable substance within the container expands during freezing.

Furthermore, when a straw is used to consume a beverage, the use of conventional ice cubes in the beverage does not achieve the advantages offered by the current invention. It is common knowledge that when ice is added to a beverage, the ice floats. Consequently, the upper, rather than the lower, portion of the beverage is cooled. When a straw is used to consume the beverage, the non-cooled lower portion of the beverage is sucked up through the straw and introduced into the consumer's mouth rather than the cooled upper portion of the beverage wherein the ice cubes reside. This is dissatisfying and contrary to the motives behind adding ice cubes to beverage containers; namely, consuming a cool beverage. The current invention solves this problem. The elongated form of the current invention assures that the frozen substance is narrow and insertable into a beverage container, beverage can, juice can, water bottle, sports bottle or the like and that the lower portion of the beverage, from which the beverage is consumed when the consumer uses a straw, is cooled.

SUMMARY OF THE INVENTION

According to one aspect of the invention, an individual disposable package for freezable substances is provided. The package is made of a polymeric material, such as polyethylene. The disposable package has a maximum width, Wm, which is less than or equal to 0.875 inches (22.23 mm).

According to another aspect of the invention the disposable package has a maximum width, Wm, which is less than or equal to 0.625 inches (15.875 mm).

According to another aspect of the disposable package has a length, X. The length X is greater than or equal to 1.5 inches (38.1 mm).

According to another aspect of the invention the width of the package is less than or equal to 0.875 inches (22.23 mm) at any point along its length.

According to another aspect of the invention the width of the package is less than or equal to 0.625 inches (15.875 mm) at any point along its length.

According to another aspect of the invention, the disposable package is comprised of a bottom portion and a top portion. The freezable substance is placed in the bottom portion and the top portion is placed over the bottom portion to seal the package and prevent spillage of the freezable substance prior to its freezing.

According to another aspect of the invention, at least one individual disposable package for freezable substances is placed in a container for efficient marketing and storage.

According to another aspect of the invention, there is provided a system for cooling a liquid in an elongated bottle utilizing an elongated frozen unit of a freezable substance. The system comprises a freezable substance; a disposable package for enclosing an individual unit of the freezable substance, the disposable package including a first portion adapted to be filled with the freezable substance prior to freezing; means for sealing the first portion; and, a container for holding a plurality of the disposable packages.

According to another aspect of the invention, the sealing means includes a cap adapted to engage and seal the first portion.

According to another aspect of the invention, the sealing means includes an adhesive.

According to another aspect of the invention, the disposable package further includes means for accessing the freezable substance.

According to another aspect of the invention, the container is formed of a transparent material.

According to another aspect of the invention, there is provided a method for cooling a liquid in an elongated bottle utilizing an elongated frozen unit of a freezable substance. The method comprises the steps of providing a freezable substance; providing a disposable package for enclosing an individual unit of the freezable substance, the disposable package including a first portion adapted to be filled with the freezable substance prior to freezing, wherein the disposable package has a length greater or equal to 1.5 inches, and wherein the disposable package has a width of less than approximately 0.875 inches; providing means for sealing the first portion; filling the first portion of the disposable package with the freezable substance prior to freezing; utilizing the sealing means to seal the first portion; freezing the freezable substance after filling and sealing the first portion to form the elongated frozen unit of the freezable substance; providing a liquid in an elongated bottle having a neck opening; accessing the frozen unit by unsealing the disposable package; and, placing the elongated frozen unit into the elongated bottle through the neck opening.

One advantage of the present invention is that beverages can be chilled in their original containers, even if the neck opening is too small for conventional ice cubes.

Another advantage of the present invention is that a single unit of the frozen material may be readily utilized due to its being individually packaged in a disposable package.

Another advantage of the present invention is that the elongated frozen units are capable of chilling a beverage throughout its length, rather than just at the surface where ice cubes congregate.

Another advantage of the present invention is that by using a cap, lid or zipper-like mechanism, as the means for sealing, the freezable substance may be removed from the first portion after the substance is frozen by unsealing the cap, lid or zipper-like mechanism, while the first portion of the package remains structurally intact. Additionally, by using a means for sealing that may be unsealed without destroying the structure of the first portion of the package, it is readily apparent that the first portion may be selectively resealable by the same means for sealing to enclose a second individual unit of the same or similar freezable liquid substance.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
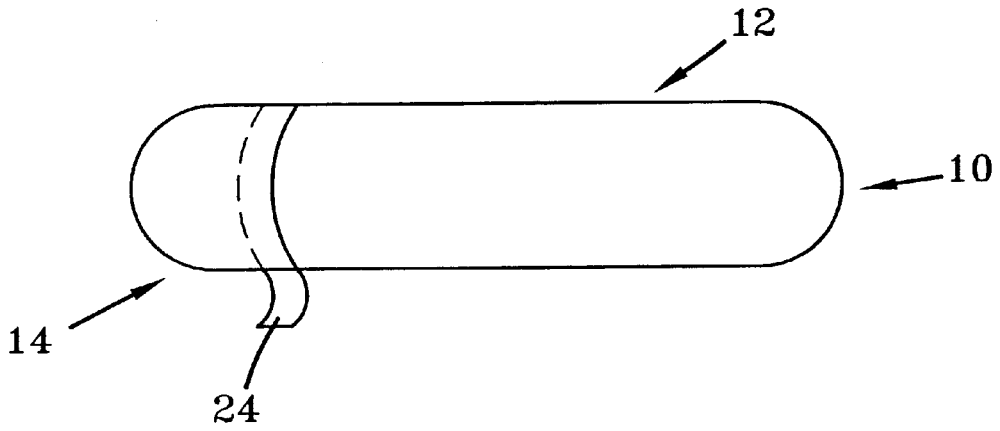
FIG. 1 is a view of an individual disposable package for freezable substances.
Figure 2:
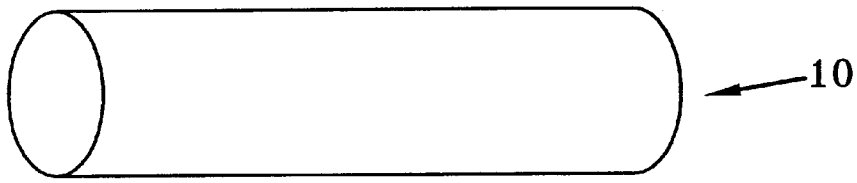
FIG. 2 is another view of an individual disposable package for freezable substances.
Figure 3:
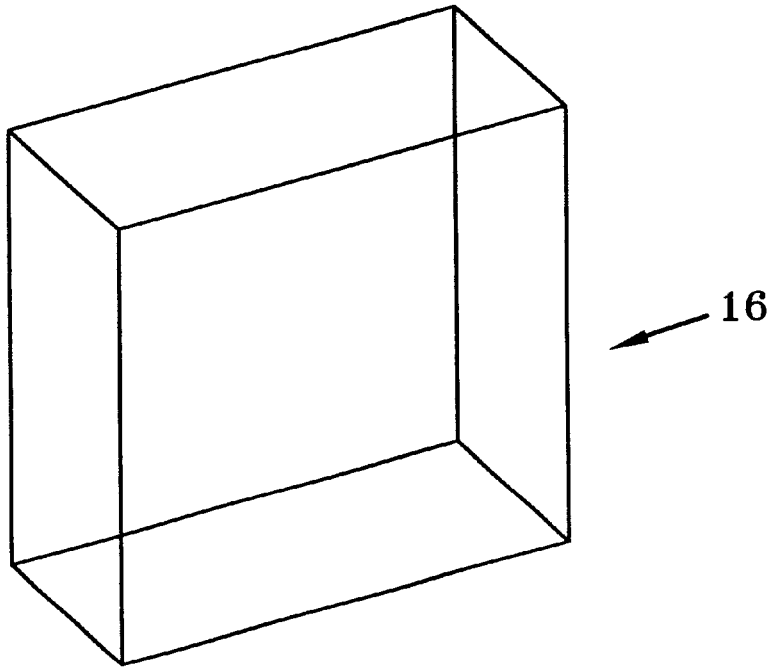
FIG. 3 is a view of an empty transparent container.
Figure 4:
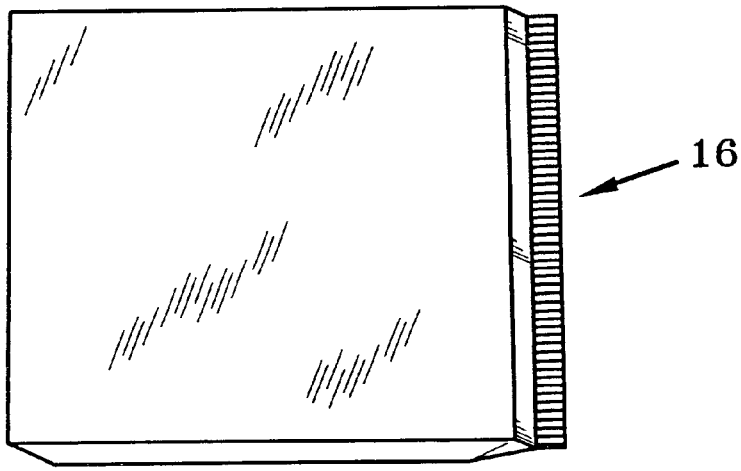
FIG. 4 is another view of an empty transparent container.
Figure 5:
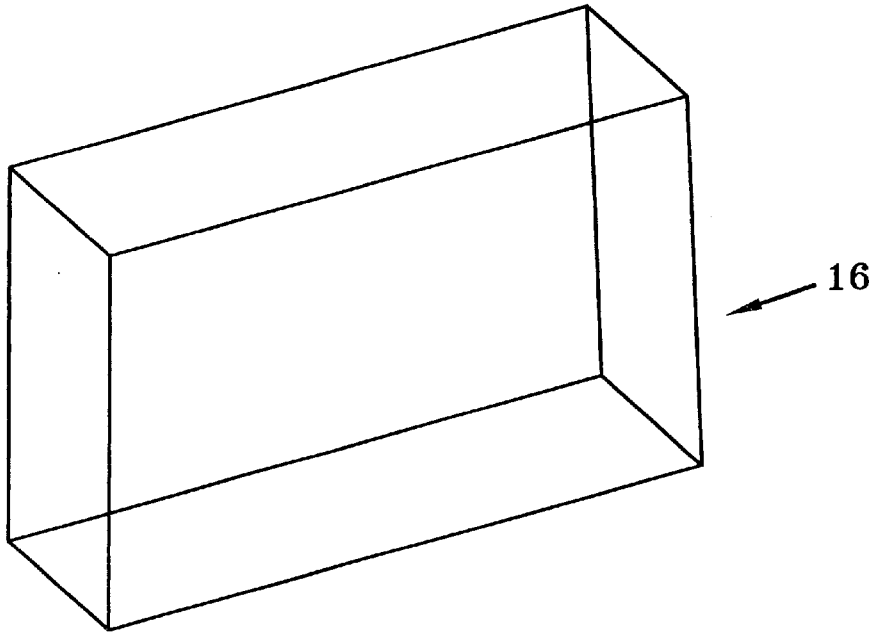
FIG. 5 is a view of a non-transparent container.
Figure 6:
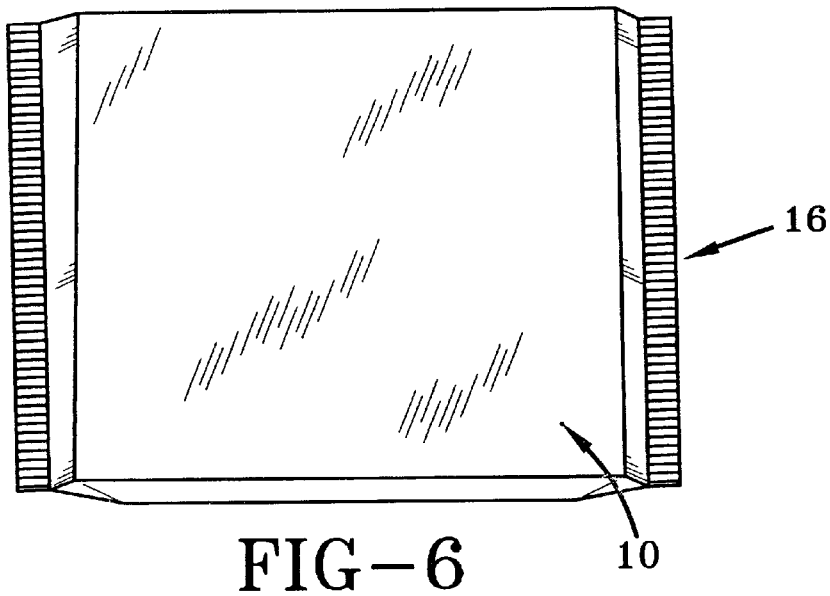
FIG. 6 is a view of the container holding four individual disposable packages for freezable substances.
Figure 7:
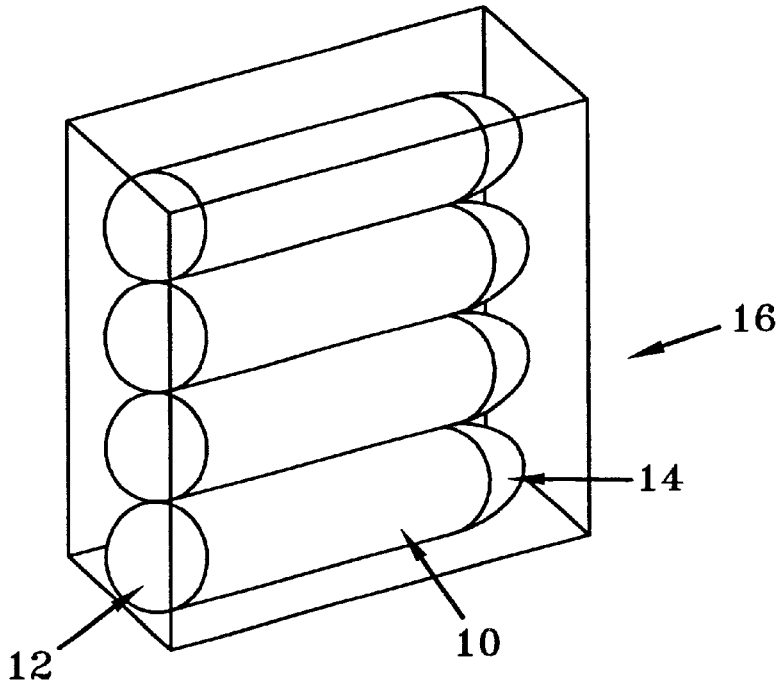
FIG. 7 is another view of a container holding four individual disposable packages for freezable substances; and, FIG. 8 is a view of the container holding eight individual disposable packages for freezable substances.
Figure 8:
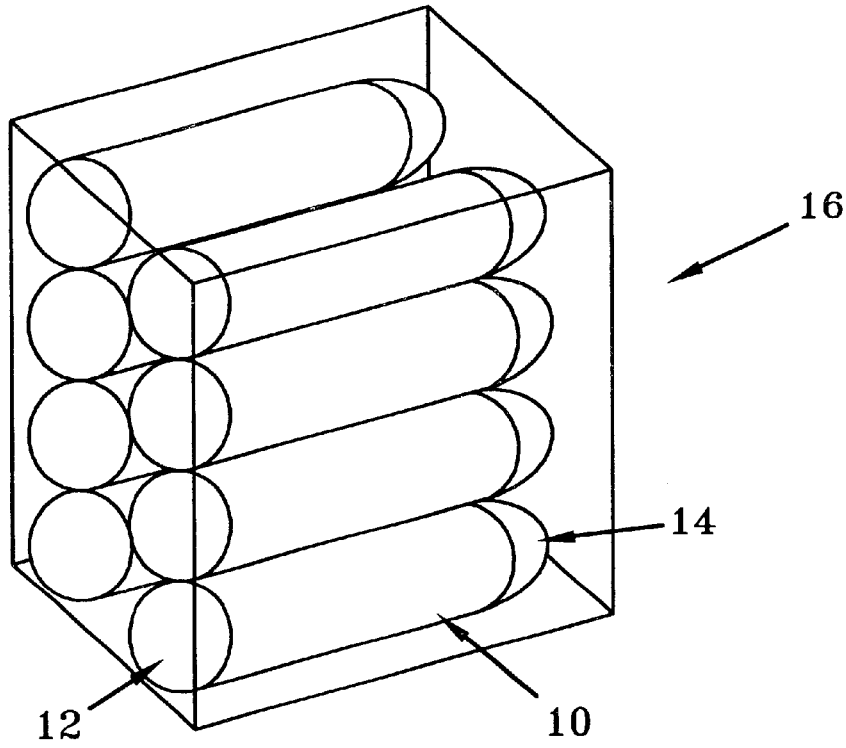

Referring now to the drawings wherein the showings are for purposes of illustrating a preferred embodiment of the invention only and not for purposes of limiting the same, FIGS. 1 and 2 show an individual disposable package 10, FIGS. 3–5 show containers 16 for the disposable packages 10 and FIGS. 6–8 show the individual disposable packages 10 in the container 16. Throughout this specification, the terms "ice cube" and "ice cube tray" will be used for convenience of the reader, even thought the shape and form of the ice formed by the inventive structure is not cubic. In addition, while the invention will be referred to in the context of freezing water to form ice, any freezable substance is within the scope of this invention With reference to FIGS. 1 and 2, an individual disposable package 10 is shown having a first portion 14, and a second portion 12. A freezable substance is placed in the first portion 14 and the second portion 12 is placed over the bottom portion 14 to seal the package and prevent spillage of the freezable substance prior to its freezing. In that way, second portion 12 acts a cap that is adapted to engage and seal the first portion 14. Means for sealing the first portion 14 may be the second portion 12, wherein the second portion is selectively removable, hollow and cylindrical such that when placed over the first portion 14, it seals the first portion 14. The first and second portions 14, 12 each have a maximum width Wm of less than or equal to 0.625 inches (15.875 mm). The disposable package 10 has a length X of greater than or equal to 1.5 inches (38.1 mm).

The maximum width Wm is important, as the primary goal of the invention is to cool drinks within their respective containers. Because most of the drink containers presently have interior diameters less than 0.625 inches (15.875 mm), the present invention provides a way to effectively cool the beverage within its original container. Further, because the ice cube is now "narrow", and because cooling is a function of surface area, the length of the ice cube is necessarily lengthened in order to provide the requisite level of cooling. Therefore, in an ice cube formed by the inventive article, the depth X is greater than a conventional ice cube. Also because of the greater surface area afforded, the preferred form of the cavity is one that will provide a generally cylindrical shaped ice cube.

In addition to the foregoing another embodiment is contemplated wherein the package 10 has an inner width less than or equal to 0.875 inches (22.23 mm) at any point along its length.

In addition to the foregoing another embodiment is contemplated wherein the package 10 has an inner width less than or equal to 0.625 inches (15.875 mm) at any point along its length.

In the preferred embodiment, the individual disposable package 10 is comprised of a first portion 14, and a second portion 12, but the disposable package 10 may be comprised of a single unit (not shown). The package 10 may be formed from a single tube with one open end. A freezable substance can be placed in the tube and the tube can be sealed to prevent spillage of the freezable substance prior to its freezing. Any sealing means, such as, adhesives, pressure sealing, a zipper-like mechanism or a lid, which seals the package and prevents spillage may be used.

In the preferred embodiment, the package 10 is formed from polyethylene. However, any other polymeric substance that adequately holds the freezable substance, prevents spillage, and is capable of withstanding freezing temperatures without significant distortions or defects may be used.

As shown in FIG. 1, in one preferred embodiment, the disposable package 10 includes means 24 for allowing access to the freezable substance after it is frozen. For example, a pull tab or a frangible region may be provided. It is contemplated within the scope of the invention that the pull tab may operate to separate second portion 12 from first portion 14. It is further contemplated, that means for allowing access to the freezable substance includes a longitudinal frangible region.

With reference to FIGS. 3–8, a container 16 for holding the individual disposable packages 10 will now be described. FIG. 3 shows a transparent container 16 manufactured from a polymeric material, such as polyethylene. In the preferred embodiment, the container 16 will hold four (4) individual disposable packages 10. The dimensions of the container 16 will vary depending of the dimensions of the packages 10. For example, a container 16 holding four (4) packages 10 having a length of 4.50 inches (114.30 mm) and an outer width of 0.875 inches (22.23 mm) will have a length of 5.875 inches (141.00 mm), a width of 3.50 inches (88.90 mm) and a height of 0.938 inches (23.825 mm).

In the preferred embodiment, the container 16 is manufactured from a transparent polymeric material. However, the container 16 may be manufactured from any material which adequately holds the packages 10 and is capable of withstanding freezing temperatures without significant distortions or defects. In addition, the container 16 does not have to be made of a clear or transparent material. The container 16 may be a colored transparency, it may be opaque, or it may be a solid color. The color and transparency of the container 16 is simply a matter of design preference.

In FIGS. 6 and 7, a container 16 holding four (4) individual disposable packages 10 is shown. However, the container 16 may hold more than four (4) packages 10, such as in FIG. 6, or it may hold less than four (4) packages 10 (not shown). Furthermore, FIGS. 6 and 7, show the packages 10 arranged in a single row, but the packages 10 can be placed in any stable arrangement, such as the double rows shown in FIG. 8.

The inventive method of chilling a beverage within its original beverage container will now be described. In a typical beverage container, the lid is removed, typically by unscrewing the lid from the container via threads. An individual disposable package 10 is removed from the container 10, and then the frozen substance is removed from the package 10 and inserted into the beverage container so that the longitudinal centerline of frozen substance is coaxial with the longitudinal centerline of the beverage container. The entire depth of the beverage is therefore cooled and chilled by the inventive article.

In the preferred embodiment, the frozen substance will be removed from the package 10 by removing the second portion 12 and squeezing the first portion 14 to expel the frozen substance. However, different methods of removal may be used depending on the type of package 10. For example, if the package 10 is sealed, the frozen substance may be removed by tearing or cutting one end of the package 10 and squeezing the package 10 to expel the frozen substance through the opening. Or, if the package 10 has a cap, the cap can be taken off and then the frozen substance can be removed from the package 10.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. An apparatus for forming cylindrical ice shapes from freezable substances, comprising:

a. a package material made of a polymeric material formed in a generally cylindrical shape;

b. said package material including a first portion adapted to be filled with a freezable liquid substance;

c. means for sealing said first portion to enclose an individual unit of said freezable liquid substance within, wherein said means for sealing said first portion is a zipper-like mechanism;

d. wherein said freezable substance is adapted to be selectively removable from said first portion after reaching a frozen state by unsealing said means for sealing, while said first portion remains structurally intact; and e. wherein said first portion remains structurally intact and is selectively resealable by said means for sealing to enclose a second individual unit of said freezable liquid substance.

2. The apparatus of claim 1 wherein said means for sealing said first portion is a second selectively removable hollow cylindrical portion placed over said first portion to seal said first portion.

3. The apparatus as in claim 1 wherein said package material has a maximum inner diameter of 2.22 cm (0.875 inches) at any point along a length of said package material, and wherein said length of said package material is greater than 3.81 cm (1.5 inches).

4. A container for holding a plurality of the apparatus defined in claim 1.

5. The apparatus as in claim 1 wherein said package material has a maximum inner diameter of 1.5875 cm (0.625 inches) at any point along a length of said package material.

6. A method for cooling a liquid in an elongated bottle utilizing an elongated frozen unit of a freezable liquid substance, the method comprising the steps of:

a. providing a freezable liquid substance;

b. providing a package material made of a polymeric material formed in a generally cylindrical shape for enclosing an individual unit of said freezable liquid substance, said package material including a first portion adapted to be filled with said freezable liquid substance;

c. providing means for sealing said first portion to enclose an individual unit of said freezable liquid substance within, wherein said means for sealing said first portion is a zipper-like mechanism;

d. filling said first portion of said package with said freezable liquid substance;

e. sealing said first portion with said means for sealing;

f. freezing said freezable liquid substance;

g. forming said elongated frozen unit of said freezable liquid substance;

h. providing a liquid in an elongated bottle having a neck opening;

i. unsealing said means for sealing, while said first portion remains structurally intact;

j. removing said elongated frozen unit of said freezable liquid substance from said first portion;

k. placing said elongated frozen unit into said elongated bottle through said neck opening; and l. refilling said first portion of said package with a second freezable liquid substance, wherein said first portion remains structurally intact and is selectively resealable by said means for sealing.

7. The method of claim 6 wherein said means for sealing said first portion is a second selectively removable hollow cylindrical portion placed over said first portion to seal said first portion.

8. The method of claim 6, wherein said package has a length greater or equal to 3.81 cm (1.5 inches), and wherein said package has a width of less than approximately 2.22 cm (0.875 inches).

9. The method of claim 6, wherein said package has a length greater or equal to 3.81 cm (1.5 inches), and wherein said package has a width of less than approximately 1.5875 cm (0.625 inches).

* * * * *